US007026587B2

(12) United States Patent
Yang et al.

(10) Patent No.: US 7,026,587 B2
(45) Date of Patent: Apr. 11, 2006

(54) COMPOSITE COOKING APPARATUS

(75) Inventors: Ha Yeong Yang, Suwon-Si (KR); Jun Young Lee, Yongin-Si (KR); Dong Lyoul Shin, Suwon-Si (KR); Jung Eui Hoh, Suwon-Si (KR); Jong Gun Kim, Hwasung-Si (KR); Alexandr Narbut, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/878,404

(22) Filed: Jun. 29, 2004

(65) Prior Publication Data

US 2005/0115959 A1 Jun. 2, 2005

(30) Foreign Application Priority Data

Nov. 29, 2003 (KR) ..... 10-2003-0085930

(51) Int. Cl.
*H05B 6/12* (2006.01)

(52) U.S. Cl. ..... 219/622; 219/623; 219/624; 219/672; 219/675; 219/601; 219/443.1

(58) Field of Classification Search ..... 219/620–627, 219/672–677, 601, 680, 443.1, 468.1; 427/487
See application file for complete search history.

(56) References Cited

U.S. PATENT DOCUMENTS

| | | | | |
|---|---|---|---|---|
| 3,979,572 | A | 9/1976 | Ito et al. | |
| 4,453,067 | A * | 6/1984 | Karklys et al. | 219/624 |
| 4,468,548 | A * | 8/1984 | Yamaki | 219/601 |
| 4,591,701 | A * | 5/1986 | Tokumaru | 219/543 |
| 4,960,611 | A * | 10/1990 | Fujisawa et al. | 427/504 |
| 5,687,642 | A | 11/1997 | Chao | |
| 6,138,343 | A * | 10/2000 | Hill et al. | 29/605 |
| 2003/0161966 | A1 * | 8/2003 | Bible et al. | 427/496 |

FOREIGN PATENT DOCUMENTS

| | | | | |
|---|---|---|---|---|
| GB | 2 223 093 | * | 3/1990 | 219/601 |
| JP | 2-213086 | * | 8/1990 | 219/622 |

* cited by examiner

*Primary Examiner*—Philip H. Leung
(74) *Attorney, Agent, or Firm*—Staas & Halsey LLP

(57) ABSTRACT

A composite cooking apparatus having a body, a heating unit, and an induction heating unit. The heating unit is positioned in the body to generate heat used to heat food. The induction heating unit is positioned adjacent to the heating unit to generate a magnetic field to cook the food by induction heating. The induction heating unit has at least one wire, a coating of which is exposed to an electron beam to strengthen a heat resistance thereof.

13 Claims, 4 Drawing Sheets

COMPOSITE COOKING APPARATUS

CROSS-REFERENCE TO RELATED APPLICATIONS

This application claims the benefit of Korean Patent Application No. 2003-85930, filed Nov. 29, 2003 in the Korean Intellectual Property Office, the disclosure of which is incorporated herein by reference.

BACKGROUND OF THE INVENTION

1. Field of the Invention

The present invention relates, in general, to composite cooking apparatuses, and more particularly, to a composite cooking apparatus that radiates electron beams to coatings of element wires forming a work coil, which is an induction heating unit, thus strengthening heat resistance.

2. Description of the Related Art

Generally, an electronic cooking apparatus that performs cooking using electromagnetic induction heating applies a magnetic force to a cooking container, and then performs cooking using heat generated from the cooking container due to the applied magnetic force. The electronic cooking apparatus generates heat using a magnetic field, so that it may perform cooking without generating air pollution. Further, the electronic cooking apparatus typically has thermal efficiency of about 80% or above, so that it is an excellent cooking machine in an aspect of energy efficiency.

A conventional electronic cooking apparatus typically includes a work coil, to which a current is supplied to generate a magnetic field, an upper plate placed on the work coil to allow a cooking container to be seated thereon, and a ferrite plate placed below the work coil to allow lines of a magnetic force to pass therethrough.

In the conventional electronic cooking apparatus having the above construction, when a current is supplied to the work coil, a magnetic field is formed around the work coil. At this time, magnetic force lines forming the magnetic field form a closed loop that connects the upper plate, an inside of a bottom of the iron cooking container and the ferrite plate.

When the magnetic force lines formed in this way pass through the inside of the bottom of the iron cooking container, an eddy current is generated in the cooking container, and heat is generated from the iron cooking container by an electrical resistance as the eddy current flows. Further, the heat generated from the iron cooking container is transmitted to food placed in the cooking container, and thus the food is cooked.

However, the conventional electronic cooking apparatus is problematic in that it performs cooking in an induction heating manner, so that only an iron container capable of executing induction heating can be used as a cooking container, and a non-iron container cannot be used as a cooking container.

Further, the conventional electronic cooking apparatus is problematic in that, when cooking is performed using only a work coil, a cooking time lengthens if an amount of food increases, so that the electronic cooking apparatus is not suitable for cooking a large amount of food.

SUMMARY OF THE INVENTION

Accordingly, it is an aspect of the present invention to provide a composite cooking apparatus, which cooks by directly generating heat through a heating unit as well as by generating heat using induction heating, thus performing cooking regardless of materials of a cooking container.

It is another aspect of the present invention to provide a composite cooking apparatus, which simultaneously drives an induction heating unit and a heating unit when a large amount of food is cooked, thus quickly performing cooking.

It is a further aspect of the present invention to provide a composite cooking apparatus having a heating unit and an induction heating unit with a work coil having a wire, in which a coating of the wire is radiated with electron beams to strengthen a heat resistance of the induction heating unit, to prevent the induction heating unit from being damaged due to heat generated from the heating unit.

Additional aspects and/or advantages of the invention will be set forth in part in the description which follows and, in part, will be obvious from the description, or may be learned by practice of the invention.

The above and/or other aspects are also achieved by providing a composite cooking apparatus, including a body, a heating unit positioned in the body to generate heat used to heat food, and an induction heating unit positioned adjacent to the heating unit to generate a magnetic field to cook the food by induction heating, the induction heating unit having at least one wire, a coating of which is exposed to an electron beam to strengthen heat resistance thereof.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
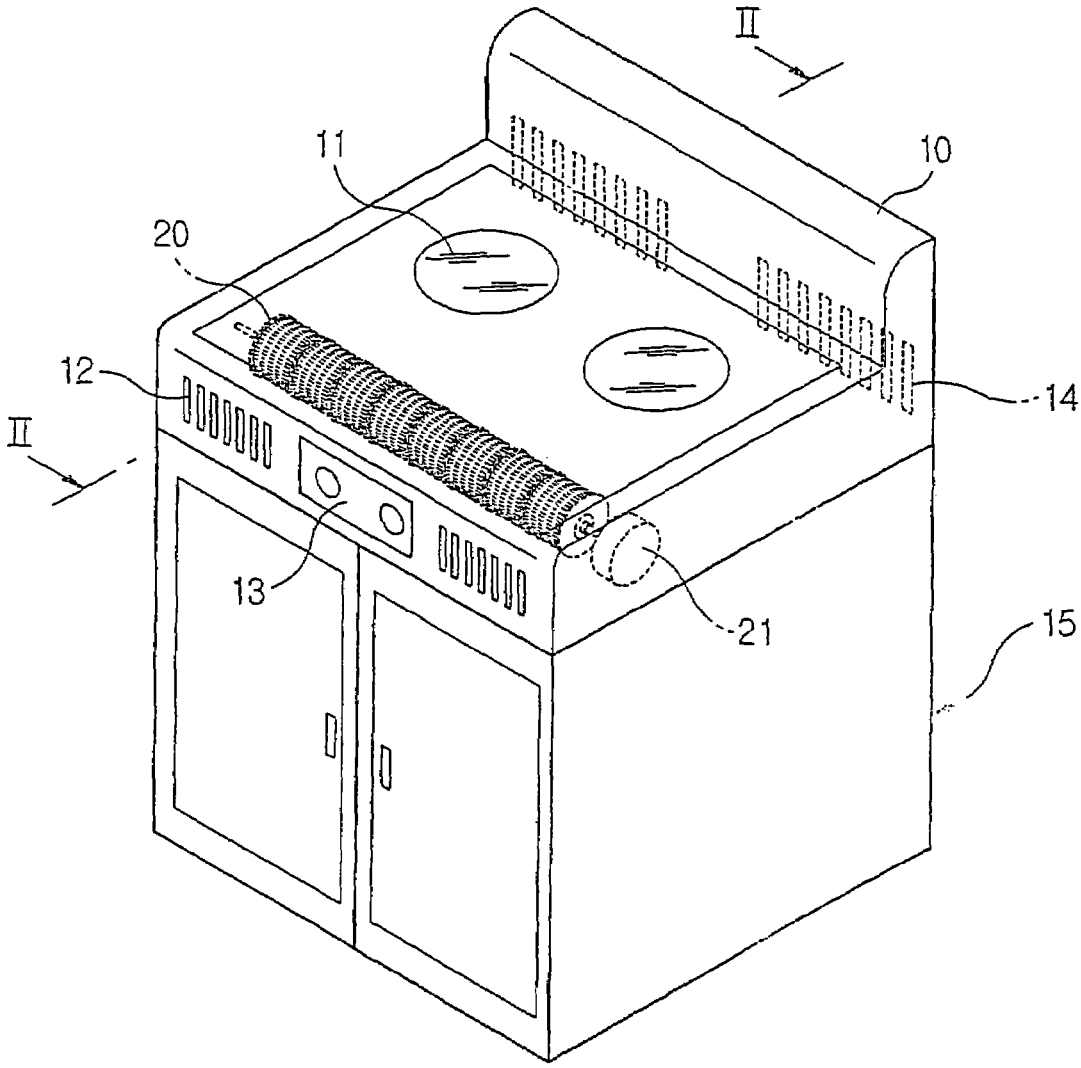
FIG. 1 is a perspective view showing an external shape of a composite cooking apparatus, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As is shown in FIG. 1, a composite cooking apparatus, according to an embodiment of the present invention, includes a body 10 and heat resisting plates 11 placed on a portion of a top surface of the body 10 to allow various cooking containers to be seated thereon. An input unit 13 is placed on a center of a front surface of the body 10 to input operation commands to the composite cooking apparatus. Inlets 12 are positioned in opposite sides of the input unit 13 to draw air used to disperse heat generated from a planar heating element (30 of FIG. 2), which will be described later, by allowing the air to move under the planar heating element (30 of FIG. 2).

Figure 2:
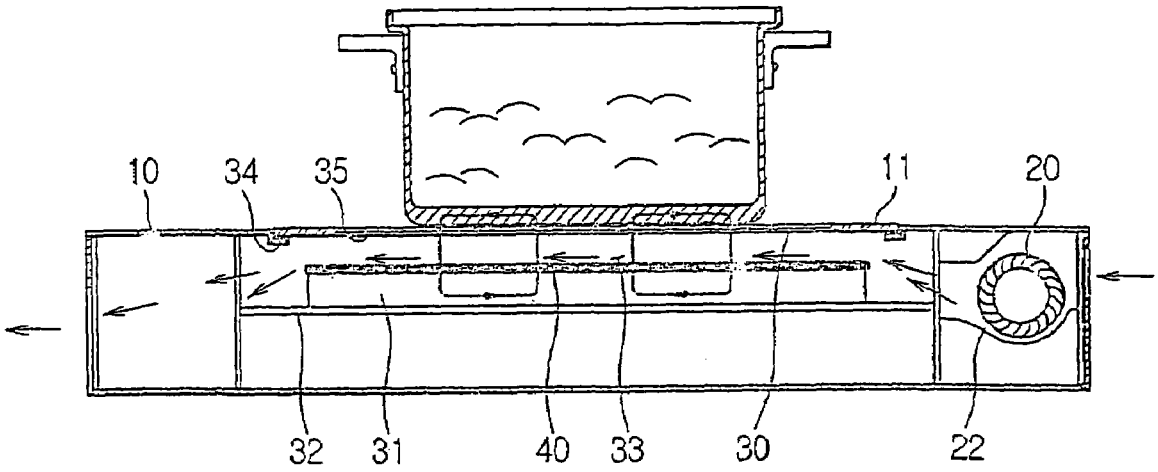
FIG. 2 is a sectional view taken along line II—II of FIG. 1.

A cylindrical blowing fan 20 is located in a front portion of an inside of the body 10 to compulsorily blow air drawn through the inlets 12 under the planar heating element (30 of FIG. 2). A fan motor 21 is provided at an end of the blowing fan 20 to rotate the blowing fan 20. Outlets 14 are positioned in a rear surface of the body 10 to discharge air flowing under the planar heating element (30 of FIG. 2) to an outside of the body 10. An auxiliary cabinet 15, in which a receiving space is formed, is placed below the body 10.

The composite cooking apparatus of the present invention, constructed as shown in FIG. 2, is provided with the planar heating element 30, positioned below the heat resisting plate 11 while coming into contact with the heat resisting plate 11. The planar heating element 30 is a product, in which high-technology ceramic materials composed of fine particles, and conductive special carbon particles are uniformly distributed on fiber fabric, and which has a uniform heating density and a low power consumption.

When a current is supplied to the planar heating element 30, heat is generated from the planar heating element 30 and food is heated by the heat. In this way, the planar heating element 30 performs cooking by directly heating a cooking container. The planar heating element 30 is inserted into a groove 35 positioned in a central lower portion of the heat resisting plate 11, which is seated on top of fixing members 34.

A work coil 40 is placed below the planar heating element 30, spaced apart from the planar heating element 30 by a predetermined distance. In this case, the work coil 40 is formed in a shape in which a Litz wire 41 (see FIG. 3) is wound in a spiral form. Magnetic force lines generated from the work coil 40 pass through an inside of a bottom of the cooking container via the heat resisting plate 11.

If variations occur in the magnetic force lines passing through the cooking container, a large amount of eddy current is generated inside a bottom of the cooking container, and heat is generated due to an electrical resistance of the cooking container to the eddy current. In this way, the work coil 40 cooks food in an induction heating manner. Because the eddy current should be generated to cook food in the induction heating manner, it is not possible to perform cooking in the induction heating manner with a cooking container made of a non-iron material, because it is incapable of generating the eddy current.

A ferrite plate 31 is positioned below the work coil 40 while coming into contact with the work coil 40. Ferrite is a solid solution, in which impurities melt in iron having a body-centered cubic crystal structure, and which functions to shield the magnetic force lines generated from the work coil 40 by allowing the magnetic force lines to pass through the ferrite. Therefore, the magnetic force lines generated from the work coil 40 form a loop passing through the ferrite plate 31 placed below the work coil 40 after passing through the inside of the bottom of the cooking container via the heat resisting plate 11. A support 32 is placed below the ferrite plate 31 to support both the work coil 40 and the ferrite plate 31.

As noted previously, the planar heating element 30 and the work coil 40 are spaced apart from each other by the predetermined distance, so that an air insulating layer is formed in a space therebetween. In this case, to further improve an insulating effect, air is compulsorily moved through the air insulating layer. Therefore, according to one aspect, the air insulating layer is mainly used as an air moving path 33.

According to one aspect, the blowing fan 20 is placed on a right side of the air moving path 33 (as is shown in FIG. 2), to compulsorily blow air into the air moving path 33. According to one aspect, the blowing fan 20 is a multi-blade cross-flow fan, which provides air drawn through the inlets 12 to the air moving path 33. An air guiding member 22 is positioned around the blowing fan 20 to guide air blown by the blowing fan 20 to the air moving path 33.

Figure 3:
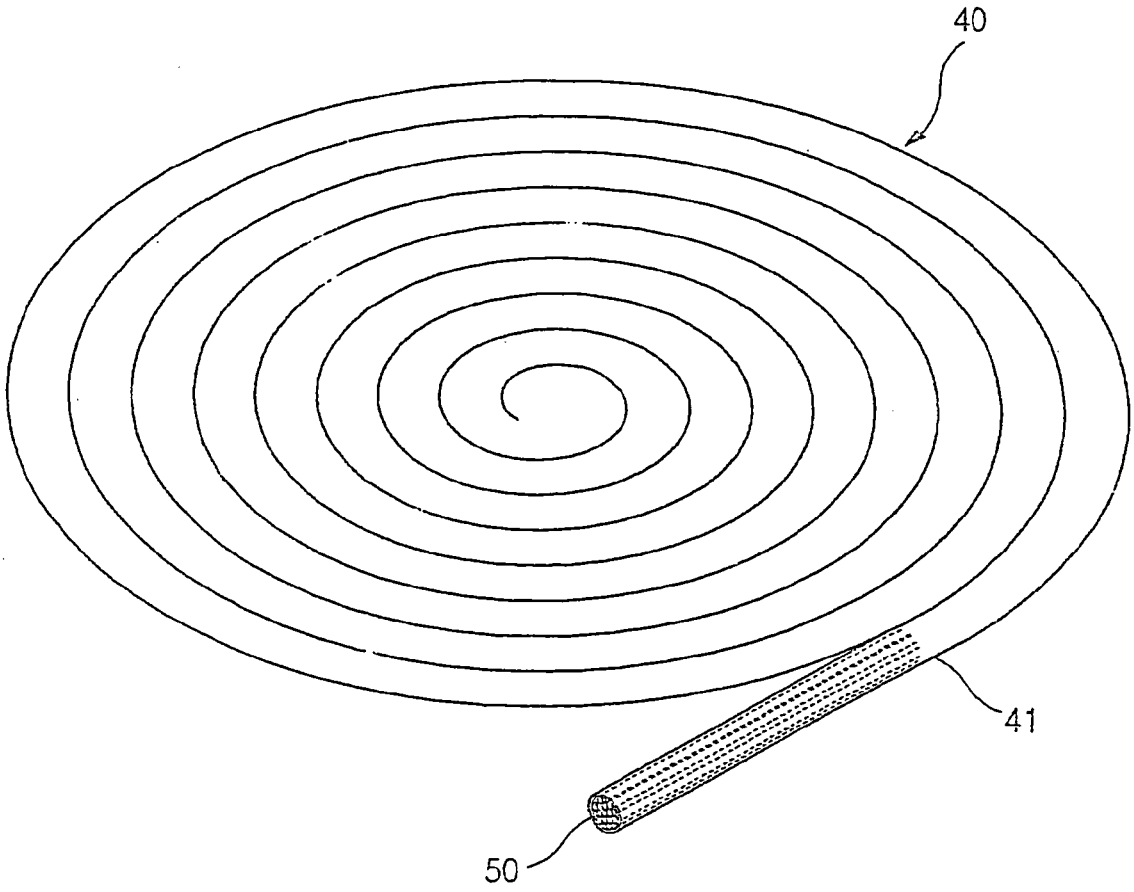
FIG. 3 is a sectional view showing a work coil of the composite cooking apparatus of FIG. 1.
Figure 4:
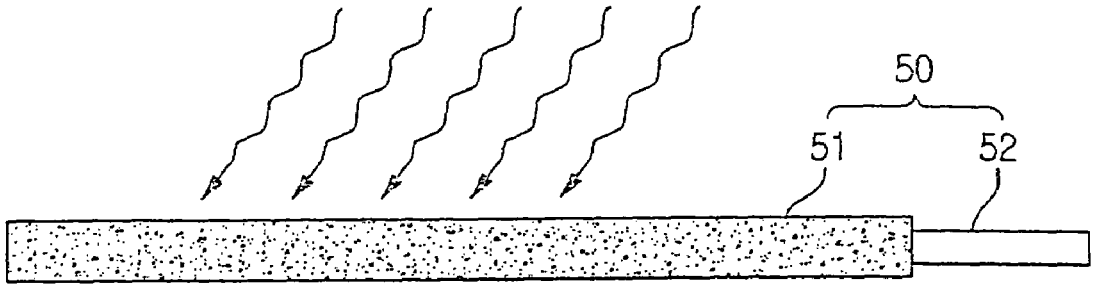
FIG. 4 is a front view showing an element wire (magnet wire) forming the work coil of the composite cooking apparatus of FIG. 1.

As is shown in FIGS. 3 and 4, the work coil 40 of the composite cooking apparatus of the present invention is formed so that the Litz wire 41 is arranged in the spiral form. The Litz wire 41 is formed by binding a plurality of element wires (magnet wires) 50, in which copper wires or aluminum wires with high electrical conductivity are applied with coatings formed at high temperatures.

Further, each of the element wires 50 of the Litz wire 41 used in the composite cooking apparatus is manufactured in such a way that an inner conductor 52 is covered with a coating 51 made of a high molecular weight compound (for example, polyester) and then an electron beam is radiated onto the coating 51. When the electron beam is radiated onto the coating 51, a molecular structure of the coating 51 is changed from an initial linear structure to a mesh structure by a cross linkage phenomenon.

In the cross linkage phenomenon, chemical bonds are formed as in the case where a bridge is placed between any two atoms of a plurality of linearly bound atoms. In this case, covalent bonds are generally formed.

A high molecular weight compound forming chemical bonds by the cross linkage forms a three-dimensional mesh structure. There are at least two methods of: adding a crosslinking agent, and radiating an electron beam.

If the coating 51 of each of the element wires 50 is changed to a mesh structure due to the radiation of the electron beam, mechanical characteristics, heat resistance, chemical resistance, internal stress resistance, and the like are improved compared to the coating with the initial linear structure. Therefore, if the electron beam is radiated onto the coating 51 of each of the element wires 50 forming the work coil 40, to prevent the work coil 40 from being damaged due to the heat generated from the planar heating element 30, an internal structure of the coating 51 is changed to strengthen heat resistance, thus effectively isolating radiation heat transmitted to the work coil 40 without installing a separate insulating plate.

According to one aspect, the element wires 50 of the work coil 40 used in the present invention are manufactured so that the coatings 51 of the element wires 50, onto which electron beams are radiated and which are made of high molecular weight compounds, are covered with magnetic viscosity layers (not shown). Viscosity of the magnetic viscosity layers is low at normal temperatures, and increases if the temperature increases above a predetermined level, so that bonds between the element wires 50 forming the Litz wire 41 are secured.

Hereinafter, an operation of the composite cooking apparatus of the present invention is described.

A user places a cooking container on the heat resisting plate 11 and then inputs an operation command to the composite cooking apparatus through the input unit 13. The operation command is then transmitted to a control unit (not shown). The control unit analyzes the operation command and then determines which of the planar heating element 30 and the work coil 40 to supply with a current.

If the input operation command requires operations of both the planar heating element 30 and the work coil 40, the control unit controls an inverter (not shown) to supply a current to both the planar heating element 30 and the work coil 40.

When the current is supplied to the planar heating element 30, a temperature of approximately 500° C. or greater is generated from the planar heating element 30 due to a resistance thereof. The resulting heat is transmitted to the cooking container placed on the heat resisting plate 11.

When a high-frequency current is supplied to the work coil 40, a magnetic field is formed around the work coil 40, so that an eddy current is formed in the cooking container due to the magnetic field. The eddy current generates heat according to an electrical resistance while passing through the cooking container. In this way, the heat generated from both the planar heating element 30 and the work coil 40 is transmitted to cook food.

A part of the heat generated from the planar heating element 30 is transmitted downward from the planar heating element 30 in a heat transmission manner using radiation. The heat emitted downward from the planar heating element 30 reaches the work coil 40. The bonds between the respective element wires 50 of the Litz wire 41 forming the work coil 40 are further secured due to the radiation of electron beams thereby strengthening heat resistance of the work coil 40. Thus, the work coil 40 is safely protected against the heat generated from the planar heating element 30.

While power is supplied to the planar heating element 30, the control unit moves air through the air moving path 33 by rotating the blowing fan 20, thus obtaining a superior heat isolating effect.

If sufficient heat is applied to the food and then the cooking has been completed, an OFF command is input by the user, and the controller receives the OFF command to shut off power supplied to both the planar heating element 30 and the work coil 40, thus terminating the cooking operation.

Through the above process, the operation of the present invention is terminated.

As is apparent from the above description, the present invention provides a composite cooking apparatus that cooks food by directly generating heat through a heating unit as well as by generating heat using induction heating, thus performing cooking regardless of the materials of a cooking container and quickly cooking a large amount of food.

Further, the present invention is advantageous in that it radiates electron beams to coatings of element wires forming a work coil, which is an induction heating unit, to strengthen heat resistance of the coatings, thus preventing the induction heating unit from being damaged due to heat generated from a heating unit without installing a separate insulating plate.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A composite cooking apparatus, comprising:

a body;

a heating unit positioned in the body to generate heat used to heat food, the heating unit including a fiber fabric having finely particulated ceramic materials and conductive carbon particles uniformly distributed thereon; and an induction heating unit positioned adjacent to the heating unit to generate a magnetic field to cook the food by induction heating, the induction heating unit having at least one coated wire, wherein a coating of the wire has been exposed to an electron beam that changes a molecular structure of the coating, to strengthen a heat resistance thereof.

2. The composite cooking apparatus according to claim 1, wherein the molecular structure of the coating is changed from an initial linear structure to a mesh structure after the coating is exposed to the electron beam.

3. The composite cooking apparatus according to claim 1, wherein the induction heating unit is wound in a spiral.

4. The composite cooking apparatus according to claim 1, wherein the at least one wire comprises a magnetic viscosity layer.

5. A composite cooking apparatus, comprising:

a body;

a planar heating element comprising a fiber fabric having finely particulated ceramic materials and conductive carbon particles uniformly distributed thereon, the planar heating element being placed in the body to generate heat used to heat food; and a work coil placed below the heating element to generate a magnetic field to cook the food by induction heating, the work coil being provided with a coating, wherein the coating has been exposed to an electron beam that changes a molecular structure of the coating, to strengthen a heat resistance thereof.

6. The composite cooking apparatus according to claim 5, wherein the molecular structure of the coating is changed from an initial linear structure to a mesh structure after the coating is exposed to the electron beam.

7. The composite cooking apparatus according to claim 5, wherein the work coil is wound in a spiral.

8. A composite cooking apparatus, comprising:

a first heating unit generating heat transferred to a cooking container; and a second heating unit, comprising a wire with a coating exposed to an electron beam to strengthen a heat resistance of the coating, and selectively generating a magnetic field, magnetic force lines of which pass through a bottom of the cooking container, wherein the first heating unit comprises a planar heating element including a fiber fabric having finely particulated ceramic materials and conductive carbon particles uniformly distributed thereon.

9. The composite cooking apparatus according to claim 8, wherein:

the second heating unit is adjacent to the first heating unit and separated from the first heating unit by a predetermined space; and the composite cooking apparatus further comprises a fan moving air through the predetermined space.

10. The composite cooking apparatus according to claim 9, further comprising:

a body having an inlet and an outlet, wherein an air moving path is defined between inlet and the outlet to guide air moved by the fan, and includes the predetermined space.

11. The composite cooking apparatus according to claim 8, wherein when the coating is exposed to the electron beam, linearly bound atoms of the coating form covalent bonds therebetween.

12. The composite cooking apparatus according to claim 8, wherein the induction heating unit comprises a Litz wire wound in a spiral.

13. A composite cooking apparatus, comprising:

a body having a cooking surface and air inlets and outlets defining respective ends of an air moving path;

a heat resisting plate disposed on the cooking surface;

a planar heating element, contacting the heat resisting plate, and comprising a fiber fabric having finely particulated ceramic materials and conductive carbon particles uniformly distributed thereon;

an induction heating unit adjacent to the planar heating element and separated from the heating element by a predetermined space, the induction unit comprising a wire with a coating exposed to an electron beam to strengthen a heat resistance thereof; and a fan forcing air through the air moving path, the predetermined space being included in the air moving path.

* * * * *